US009567882B2

(12) United States Patent
Flaig

(10) Patent No.: US 9,567,882 B2
(45) Date of Patent: Feb. 14, 2017

(54) SCREW PLUG MADE OF A METALLIC MATERIAL, METHOD FOR THE PRODUCTION THEREOF, CORRESPONDING BLANK, AND CORRESPONDING TOOL

(76) Inventor: Hartmut Flaig, Aldingen (DE)

( * ) Notice: Subject to any disclaimer, the term of this patent is extended or adjusted under 35 U.S.C. 154(b) by 56 days.

(21) Appl. No.: 13/184,742

(22) Filed: Jul. 18, 2011

(65) Prior Publication Data

US 2011/0314887 A1 Dec. 29, 2011

Related U.S. Application Data

(62) Division of application No. 10/539,925, filed as application No. PCT/EP03/13470 on Nov. 29, 2003, now abandoned.

(30) Foreign Application Priority Data

Dec. 16, 2002 (DE) ..... 102 58 994
May 14, 2003 (DE) ..... 103 21 544

(51) Int. Cl.
*F01M 11/04* (2006.01)
*B21J 5/12* (2006.01)
(Continued)

(52) U.S. Cl.
CPC ..... *F01M 11/0408* (2013.01); *B21J 5/12* (2013.01); *B21K 1/463* (2013.01); *B21K 21/08* (2013.01)

(58) Field of Classification Search
CPC ..... B21C 23/085; B21C 23/217; B21C 23/20; B21D 22/04; B21D 41/02; B21D 39/20; B21J 13/02; B21J 5/12; B23G 7/00; B21K 1/56; B21K 21/08; B21K 1/463; F01M 11/0408; F16B 25/103
(Continued)

(56) References Cited

U.S. PATENT DOCUMENTS 43,218 A 6/1864 McGhan
115,127 A 5/1871 Snyder et al.
(Continued)

FOREIGN PATENT DOCUMENTS

EP 0036050 9/1981
EP 0404570 12/1990
(Continued)

OTHER PUBLICATIONS

"Don't Over-Tighten That Sump Plug" URL:http://web.archive.org/web/20020501145158/http://faq.f650.com/FAQs/Sump_Plug_FAQ.htm_Feb. 25, 2009.

*Primary Examiner* — David Bryant
*Assistant Examiner* — Lawrence Averick
(74) *Attorney, Agent, or Firm* — Bachman & LaPointe, PC

(57) ABSTRACT

A screw plug for a liquid conduit, particularly an oil pipe or an oil container, comprising a cylindrical shaft that is placed on a top plate and is provided with an external thread. A pocket hole having a polygonal cross section is centrally arranged on the top plate as a receiving member for a tool. The shaft is embodied as a tubular butt that is provided with the external thread. A pocket hole which is arranged coaxial to the pocket hole of the top plate extends from the face of the shaft. In order to produce the screw plug, a blank comprising the cylindrical tubular butt that is connected to the top plate in a molded on manner is made, the inner diameter and outer diameter of the tubular butt being smaller than the final corresponding diameters (e, f) of the screw plug. The tubular butt of the blank is then enlarged by applying pressure to the inner wall surface of the pocket hole thereof. Also disclosed is a tool in which one end of a pressure die is fixed as a mandrel-type tool while a supporting or holding head which is disposed so as to be movable
(Continued)

relative thereto and encompass a seat for a blank is associated with the free end thereof.

12 Claims, 2 Drawing Sheets

(51) Int. Cl.
*B21K 1/46* (2006.01)
*B21K 21/08* (2006.01)

(58) Field of Classification Search
USPC ..... 72/264–267, 358, 359, 370.06–370.08,72/393; 470/8–10, 64–267, 358
See application file for complete search history.

(56) References Cited

U.S. PATENT DOCUMENTS

| | | | | | |
|---|---|---|---|---|---|
| 1,427,616 | A | | 8/1922 | Moore | |
| 1,458,006 | A | * | 6/1923 | Runser | 470/8 |
| 1,498,416 | A | | 6/1924 | Willett | |
| 1,507,091 | A | | 9/1924 | Runser | |
| 1,642,736 | A | * | 9/1927 | Lyman | 470/8 |
| 1,701,786 | A | | 2/1929 | McMurray | |
| 1,716,334 | A | | 6/1929 | Wilson | |
| 1,822,114 | A | * | 9/1931 | Schwartz | 220/288 |
| 1,891,033 | A | | 12/1932 | Wackman | |
| 1,901,911 | A | | 3/1933 | Kahn | |
| 2,036,419 | A | | 4/1936 | Liner | |
| 2,235,617 | A | | 3/1941 | Klinzing | |
| 2,408,267 | A | | 9/1946 | Moore | |
| 2,474,430 | A | | 6/1949 | Laue | |
| 2,542,377 | A | * | 2/1951 | Turkish | F16B 39/286 123/90.52 |
| 2,667,650 | A | * | 2/1954 | Friedman | 470/9 |
| 2,962,185 | A | * | 11/1960 | Starr | B65D 39/084 220/254.8 |
| 3,189,209 | A | | 6/1965 | Owens | |
| 3,245,096 | A | * | 4/1966 | McKay | F16B 39/284 470/14 |
| 3,264,850 | A | | 8/1966 | Bower | |
| 3,380,618 | A | | 4/1968 | Phillips | |
| 3,568,230 | A | * | 3/1971 | Rosan, Sr. | 470/8 |
| 3,843,984 | A | * | 10/1974 | Bagheri et al. | 470/8 |
| 3,870,084 | A | | 3/1975 | Gezari | |
| 3,893,487 | A | | 7/1975 | Engelking | |
| 4,301,563 | A | * | 11/1981 | Deveney, Jr. | 470/10 |
| 4,373,561 | A | * | 2/1983 | Berger | 141/330 |
| 4,506,705 | A | * | 3/1985 | Thompson | 138/89 |
| 5,433,489 | A | | 7/1995 | Kimura et al. | |
| 5,487,633 | A | | 1/1996 | Roberts | |
| 5,716,280 | A | * | 2/1998 | Elcock et al. | 470/9 |
| 5,782,697 | A | * | 7/1998 | Hommelet et al. | 470/8 |
| 6,155,761 | A | * | 12/2000 | Donovan | 411/386 |
| 6,357,274 | B1 | * | 3/2002 | Tanaka et al. | 72/356 |
| 6,508,520 | B2 | | 1/2003 | Sampson et al. | |
| 6,854,942 | B1 | | 2/2005 | Hargis | |
| 7,308,970 | B2 | | 12/2007 | Holub | |
| 2002/0162407 | A1 | * | 11/2002 | Nightlinger et al. | 74/1.5 |

FOREIGN PATENT DOCUMENTS

| | | |
|---|---|---|
| EP | 0 461 344 | 12/1991 |
| GB | 806387 | 12/1958 |
| GB | 1274754 | 5/1972 |
| JP | 61165245 | 7/1986 |

* cited by examiner

SCREW PLUG MADE OF A METALLIC MATERIAL, METHOD FOR THE PRODUCTION THEREOF, CORRESPONDING BLANK, AND CORRESPONDING TOOL

CROSS-REFERENCE TO RELATED APPLICATION

This application is a Divisional Application of parent U.S. patent application Ser. No. 10/539,925, filed Jun. 16, 2005 which is a U.S. National Stage of PCT/EP2003/013470, filed Nov. 29, 2003 which claims priority of German Applications 102 58 994.1, filed Dec. 16, 2002, and 103 21 544.1, filed May 14, 2003.

BACKGROUND OF THE INVENTION

The invention relates to a screw plug of metallic material for a fluid line, in particular for an oil line or oil tank, having a cylindrical shank, comprising an external thread, on a top plate in which a blind hole of polygonal cross section is provided centrally as a receiving member for a tool. In addition, the invention covers a method and a blank for manufacturing this screw plug and a tool for the production thereof.

Screw plugs of this type are used in particular in motor vehicles and have therefore to be produced in large numbers. It has hitherto proven favourable for the production thereof to have to be performed in at least three manufacturing stages. The object of the invention is to modify this in the direction of an improvement.

SUMMARY OF THE INVENTION

The object is achieved by providing a screw plug of metallic material for a fluid line, in particular for an oil line or oil tank, having a cylindrical shank, comprising an external thread, on a top plate in which a blind hole of polygonal cross section is provided centrally as a receiving member for a tool, characterised in that the shank takes the form of a tube stub provided with the external thread and from the end face of the shank there extends a blind hole which is coaxial with the blind hole in the top plate and a method for producing same.

According to the invention, the shank takes the form of a tube stub provided with the external thread, a newly conceived blind hole which is coaxial with the conventional blind hole in the top plate extending from the end face of the shank of the screw plug. Of particular significance is the fact that, where a bevelled portion widening towards the top and inclined axis-wards from the top plate, at an angle in longitudinal section of preferably 30°, is provided as transition to the tube stub, the tube-ward foot contour of this bevelled portion is designed to be at the same time, structurally, an inner starting line for the external thread projecting radially beyond this contour. Furthermore, a diameter of 19.5 mm is preferred for the foot contour of the bevelled portion.

It has proven favourable for the deepest point of the blind hole in the tube stub to exhibit a cross-section inclined from the wall surface thereof to the longitudinal axis of the screw; advantageously, the depth of the wall surface should amount to around 8 mm, in particular 7.8 mm.

According to a further feature of the invention, the diameter of the blind hole measures around 14 mm and the external diameter of the external thread around 21 mm; the dimensions should in particular cover the values of 13.8 mm and 20.97 mm respectively.

The design of the screw plug according to the invention is also characterised in that at least one bevelled edge, preferably one on each side, inclined away from the free tube edge of the tube stub towards the top plate is associated with said tube edge, wherein the externally positioned bevelled edge is designed to develop into the external thread.

The invention in particular covers a method of producing this screw plug, in which a blank with a cylindrical tube stub formed on and adjoining a top plate is produced, whose internal diameter and external diameter are smaller than the corresponding diameters intended for the screw plug; the tube stub of the blank is expanded by simultaneously exerting pressure on the inner wall surface of the blind hole thereof. According to another feature of the invention, a plunger is driven as a mandrel-type tool into the blind hole in the tube stub blank and the walls of the tube stub are expanded radially thereby.

It has proven favourable, in this respect, for the outer surface of the tube stub to be forced out radially beyond the foot contour of the bevelled portion of the blank adjoining the top plate and inclined cross-sectionally axis-wards; the external thread is intended to be formed in the outer surface of the expanded tube stub, advantageously in the area of the tube stub determined in the axis-ward direction by said foot contour of the bevelled portion. This process of forming the thread in the outer surface is advantageously performed by a separate thread rolling process after the screw plug has been shaped as described above.

However, the invention also covers a method, in the course of which the outer surface of the tube stub is pressed during expansion thereof against a die surface surrounding it and comprising a negative of the thread.

Of particular significance is the blank used in the method to produce the screw plug; in said blank, the top plate is adjoined by a cylindrical tube stub with an external diameter and a blind hole diameter whose dimensions are smaller than those of the external diameter and hole diameter of the actual screw plug; the diameter of the blind hole should measure around 12 mm and the external diameter of the tube stub around 19 mm, preferably 19.2 mm. The dimensional difference relative to the end product is compensated by the expansion process.

It has also proven favourable for the external diameter of the tube stub on the blank to be smaller than the foot diameter of the bevelled portion on the screw plug; the latter bevelled portion, as well as the bevelled portion of the blank, should form an angle with the longitudinal axis of the blank which preferably measures around 30°.

According to another feature of the invention, a bevelled edge inclined away from the tube edge is also associated in each case on both sides with the tube edge of the tube stub, wherein the outer bevelled edge develops into the cylindrical outer tube surface.

Also of inventive significance is a tool with which shaping of the blank may be simply performed; according to the invention, a plunger is fixed at one end in a housing as a mandrel-type tool and the free end thereof is associated with a carrying or holding head arranged movably relative thereto and having a receptacle for a blank; the axis thereof extends in the central axis of the tool or the plunger. It is additionally favourable for a stationary base plate to be provided at the end of the bush-like housing remote from the carrying or holding head, which base plate forms an abutment for the plunger seated thereon. The free end of the plunger partially surrounded by a plunger tube is designed, according to the invention, to engage in a central bore in the carrying or holding head, wherein a pressure head of the plunger then projects axially beyond the edge of the mouth of the plunger tube. To this end, it has proven favourable for this plunger tube to be seated at its other end, preferably with a flange foot, on a stationary upright bush of the tool, which forms a bearing surface for the plunger passing through the upright bush. In order to improve the pressing process, a central pressure base may be formed on the base plate, forming a common abutment for the plunger and the upright bush.

The invention is also characterised in that the carrying or holding head of the tool is seated on a slide bush, which is associated coaxially with the plunger and the upright bush. The diameter of the pressure base is designed to match the diameter, seated thereon, of the slide bush.

The latter additionally comprises, on a foot portion associated with the pressure base, a head portion wider radially than said foot portion and is designed, with the holding head, to be surrounded supportingly by a guide chuck and to be axially movable therewith relative to the housing.

To assist in the movement of the base plate and the guide chuck, an energy storing device, in particular a profile element of resilient material, is arranged according to the invention between said tool parts. This profile element is preferably positioned in the manner of a ring around the pressure base of the base plate and may be made from strands of material of different cross-sectional shape.

Finally it has proven favourable for the blank seated in the carrying or holding head to be capable of being forced, on axial movement thereof, onto the pressure head of the plunger, wherein the diameter of the plunger is larger than the diameter of the blind hole in the blank, i.e. on insertion of the plunger the blank expands.

All in all, an attractively simple method is provided for producing the above-mentioned screw plugs.

BRIEF DESCRIPTION OF THE DRAWINGS

Further advantages, features and details of the invention are revealed by the following description of a preferred exemplary embodiment and with reference to the drawings, in which.

DETAILED DESCRIPTION

Figures 1, 2, 3, 6:
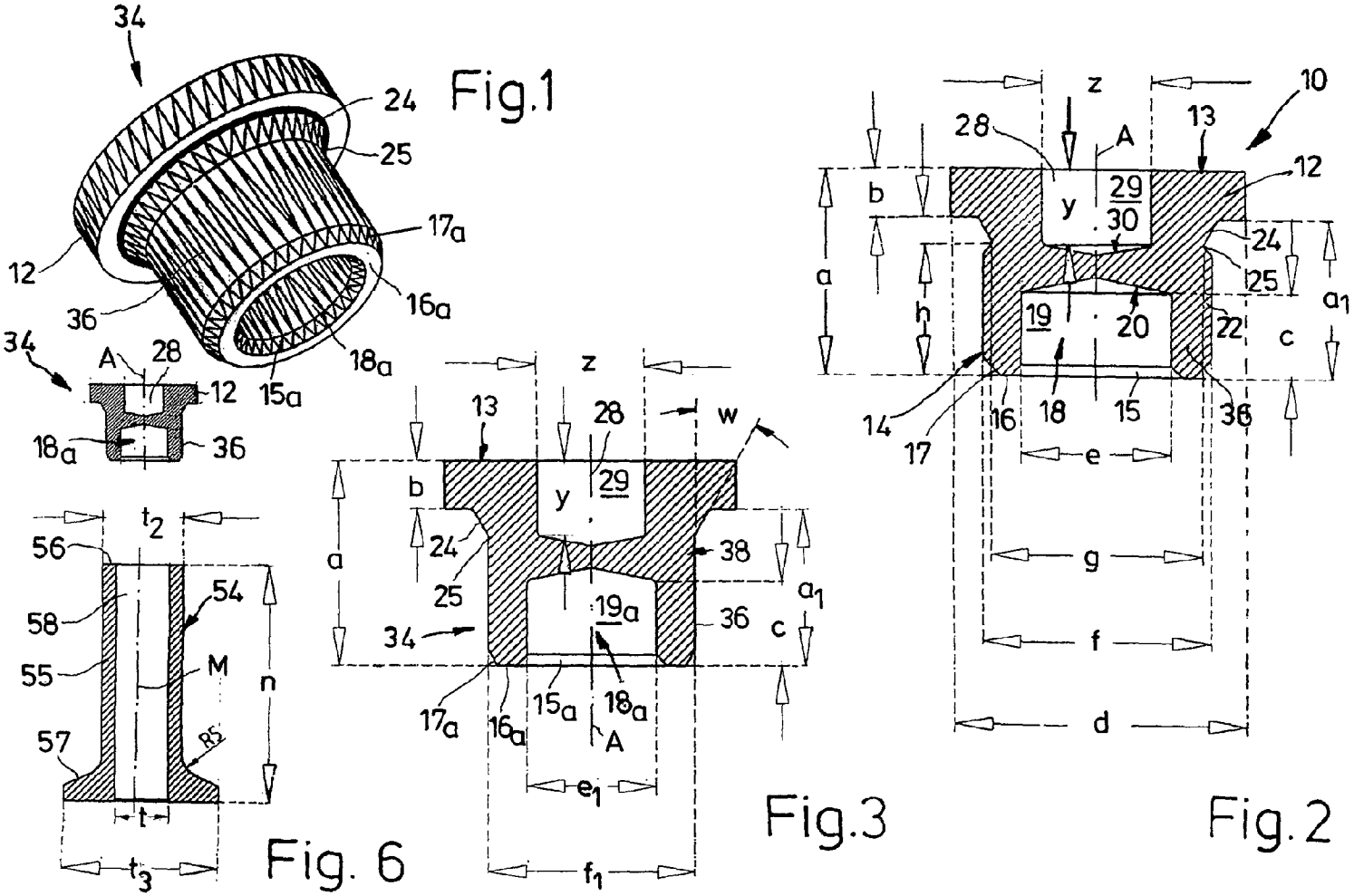
FIG. 1: is an oblique schematic view of a blank according to the invention for a screw plug.
FIG. 2: shows a diametral section through the screw plug.
FIG. 3: is a representation corresponding to FIG. 2 of the blank for producing the screw plug.
FIG. 6: shows a longitudinal section through the plunger with associated blank.

A screw plug 10 for an oil line or an oil tank of a motor vehicle, not shown for reasons of clarity, comprises, formed on a disk-shaped top plate 12 of an axial height b of 4.5 mm and a diameter d of around 27 mm, a tube stub 14 of an external diameter f of 20.97 mm extending axially relative to the longitudinal axis A of the screw plug 10; the axial height a of the screw plug 10 measures 19 mm, from which a height c of 14.5 mm is calculated for the tube stub 14.

A blind hole 18 of a diameter e of 13.8 mm and a wall depth c of 7.8 mm is provided in the tube stub 14, extending from the end face thereof constructed as a tube edge 16, the deepest point 20 of said blind hole 18 being inclined centrally from the wall surface 19 of the blind hole towards the longitudinal axis A of the screw when viewed in cross-section, i.e. forms a flat conical surface. The tube edge 16 is associated with a bevelled edge 15 inclined towards the blind hole 18.

Such an inclined bevelled edge 17 also surrounds the tube edge 16 on the outside and develops into an external thread 22 of the external diameter f of 20.97 mm and the height h of 12 mm. A formed-in bevelled portion 24 of an axial height i of 2.5 mm, widening conically towards the top plate 12 at a cross-sectional angle w of 30° (see FIG. 3), adjoins the upper edge of the external thread 22. The edge-ward foot diameter g thereof measures 19.5 mm. The external thread 22 starts at the tube-ward foot contour 25 of the bevelled portion 24 and projects radially therebeyond.

From the surface 13 of the top plate 12 there extends a central blind hole 28 of hexagonal cross section of a diameter z of around 4.8 mm (SW 10) and a wall depth y of 7 mm. The deepest point 30 of this hole is also inclined centrally from the wall surface 29 towards the longitudinal axis A of the screw, likewise forming a flat conical surface. A tool, not shown in the drawings, is inserted into this top blind hole 28 for turning the screw plug 10.

To produce the screw plug 10, a blank 34 illustrated in FIG. 3 of metal (of $19MnB_4$ for example) is made, comprising the top plate 12, containing the top blind hole 28, together with a cylindrical tube stub 36 formed thereon; while the top plate 12 corresponds in its dimensions and those of its blind hole 30 (b, d, y, z) to those of the finished screw plug 10, the tube stub 14 thereof differs in configuration from the tube stub 36 of the blank 34. The outer tube surface 38 here starts at the end of the inclined bevelled portion 24, likewise exhibiting the final dimensions g, w, remote from the top plate 12; the diameter $f_1$ of its cylindrical contour amounts to 19.2 mm, and is therefore 1.77 mm smaller than the external diameter f in the case of the finished screw plug 10. The diameter $e_1$ of the blind hole $\mathbf{18}_a$ present in the blank 34 and adjoining the inner bevelled edge $\mathbf{15}_a$ of the tube edge $\mathbf{16}_a$ measures 12 mm, and is therefore 1.8 mm smaller than the diameter e in the case of the finished screw plug 10. The outer bevelled edge is here designated $\mathbf{17}_a$.

To produce the screw plug 10 from the blank 34, the tube stub 36 thereof is expanded, for instance by driving a mandrel into the blind hole $\mathbf{18}_a$ and exerting pressure on the wall surface $\mathbf{19}_a$ of the latter, dimensionally accurately into the tube stub 14, wherein the external thread 22 may be formed without difficulty.

Figure 5:
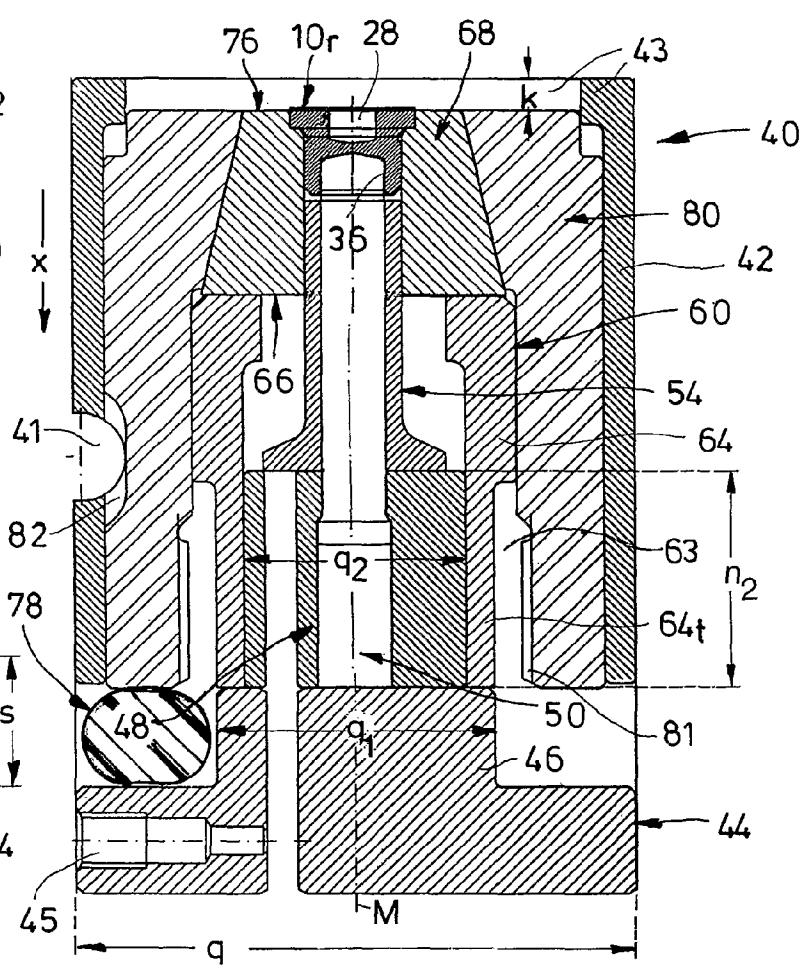
FIG. 5: is a representation corresponding to FIG. 4 of the tool at the end of the shaping process with resultant screw plug.
Figure 4:
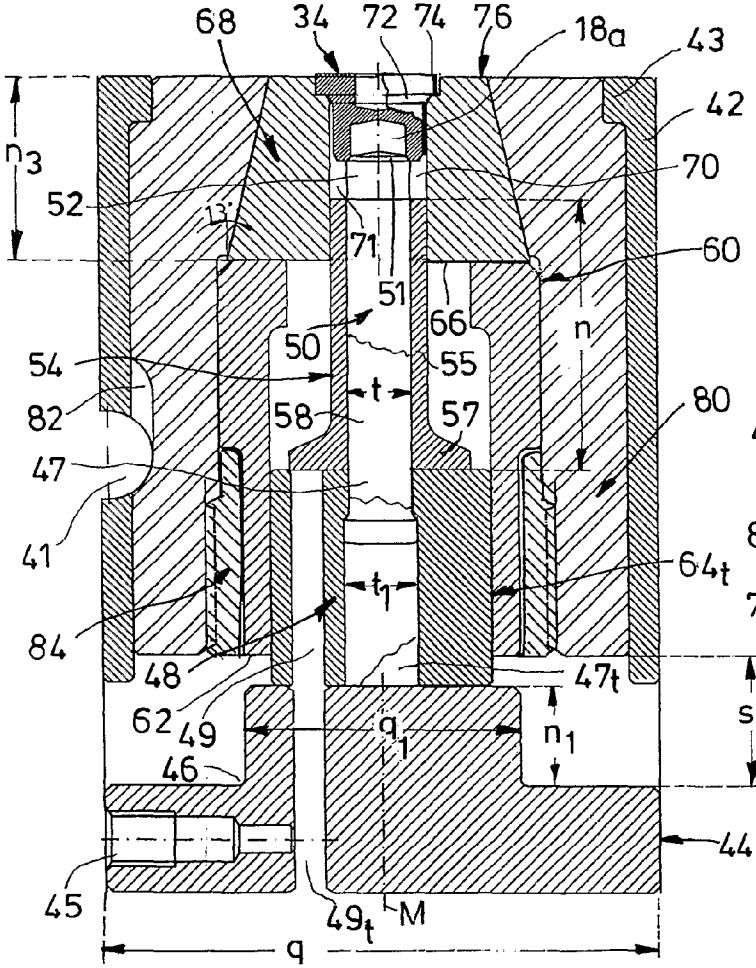
FIG. 4: shows a longitudinal section through a tool for producing the screw plug, with a blank inserted above a plunger prior to start of the shaping process.

A tool 40 for a preferred method of producing the screw plug 10 is revealed in FIGS. 4 to 6. Coaxially with the central axis M thereof, a base plate 44 with centrally formed-on pressure base 46 of a diameter $q_1$ of 60 mm and a height $n_1$ of 21.5 mm and with a radial stepped bore 45 is associated with a cylindrical tool housing 42 of an external diameter q of for example 120 mm.

An upright bush 48 of a length $n_2$ of approximately 47 mm, with an axial bore 47 which offers a cross-sectionally wider end portion $\mathbf{47}_t$ of a diameter $t_1$ of 16 mm, is seated on the pressure base 46. This axial bore 47, $\mathbf{47}_t$ accommodates a plunger 50 constituting a mandrel-type tool, which is surrounded above the upright bush 48 by a plunger tube 54 of a length n of virtually 60 mm, consisting of a tube portion 55 with a flange foot 57 formed thereon at one end of a diameter $t_3$ of around 40 mm; the external tube diameter $t_2$ measures 21 mm, the internal diameter t of the inside 58 of the tube around 14 mm. The latter is continued downwards by the axial bore 47 of the upright bush 48. Adjacent the axial bore 47, $47_t$ and at a radial distance therefrom there extends in the upright bush 48 an additional axially parallel bore 49 of smaller diameter, which is aligned with a corresponding bore $49_a$ in the base plate 44.

A slide bush 60 of a height of around twice the above-mentioned length $n_2$ is fitted externally on the upright bush 48 of diameter $q_2$; the lower edge 62 of said slide bush is seated in FIG. 5 on the central pressure base 46 of the base plate 44. The cylindrical outer surface of the lower half or the foot portion $64_t$ of the slide bush 60 continues the outer surface of the pressure base 46 and defines a cylindrical cavity 63. At a distance from the lower edge 62 corresponding approximately to the length $n_2$ of the upright bush 48 there begins a broader head portion 64 of the slide bush 60, which bears on its top face 66 a holding head 68, of upwardly tapering cross-section, with a central bore 70; this accommodates the upper end of the tube portion 55 of the plunger tube 54, whose external diameter $t_2$ determines the diameter of the bore 70. The height $n_3$ of the holding head 68 is slightly smaller than the length $n_2$ of the upright bush 48.

Between the outer tool housing 42 on the one hand and the slide bush 60 and the holding head 68 on the other there extends a guide chuck 80 filling the space and likewise resembling a bush. This surrounds the slide bush 60 and the holding head 64 in form-fitting manner and may be displaced axially in the tool housing 42 as a unit together with these inner parts. In the area of the cavity 63, it is provided with a thread 81 for a screw bush 84, which extends in said cavity 63.

43 denotes a guide edge of the housing 42 directed towards the central axis M, and 41 denotes a radial guide member, which engages in an axially parallel guide recess 82 in the guide chuck 80.

The top portion of the bore 70 is adapted cross-sectionally to the structural configuration of the screw plug 10, i.e. the diameter of the bore 70 corresponds, with slight play, to the external diameter f of the tube stub 14 of the screw plug 10 and widens, for instance at a distance from the end face 76 of the holding head 68 corresponding to the axial height b of the top plate 12, from a conical annular plane 72 of the bore wall 71, corresponding to the inclined bevelled portions 24 of the screw plug 10, as far as a step 74, on which the top plate 12 of the blank 34 is positioned according to FIG. 4. The circumference of the tube stub 36 thereof extends with annular spacing relative to the bore wall 71 of the central bore 70.

During this insertion process, the bevelled edge $15_a$ of the blank 34 stands, at a distance from the edge 56 of the mouth of the tube portion 55, on the correspondingly inwardly sloping top or bevelled edge 51 of the end-ward portion or pressure head 52 of the plunger 50, which projects correspondingly beyond the edge 56 of the mouth of the plunger 54. The diameter of this top edge 51 corresponds to the diameter e of the blind hole 18 of the screw plug 10, i.e. it is larger than the corresponding diameter $e_1$ on the blank 34.

For the pressing or shaping process, the guide chuck 80 is lowered inside the housing 42 in the shaping direction x towards the base plate 44 against a profile ring of resilient material indicated at 78 and of approximately circular cross-section, i.e. the spacing s between them is reduced, wherein the plunger or pressure head 52 of the stationary plunger 50 penetrates into the blind hole $18_a$ in the blank 34 and expands the tube stub 36 until the outer surface 38 thereof lies against the bore wall 71 of the bore 70. The pressing distance k, which is here 7 mm, is shown in FIG. 5. The profile ring 78 arranged between base plate 44 and guide plate 80 may, moreover, be of different cross-sectional configuration than is shown schematically in FIG. 5, optionally it may take the form of a hollow profile.

After the shaping process, the still not quite finished screw plug $10_r$ is removed from the holding head 68 and its expanded tube stub 36 is provided with an external thread 22; then the screw plug 10 is ready for use.

The invention claimed is:

1. Method for producing a screw plug for an oil line or an oil vessel, the screw plug comprising a cylindrical tube stub (36) having an external thread (22), the tube stub (36) extending from a top plate (12) having a blind hole (28) of polygonal cross-section positioned centrally as a receiving member for a tool, the tube stub (36) having the external thread (22) and a blind hole (18) which is coaxial with the blind hole (28) of the top plate (12) and extends from an end face (16) of the tube stub (36), the screw plug being of metal material and comprising a bevelled portion (24), which is inclined from the top plate (12) towards a longitudinal axis of the screw plug, as a transition to the tube stub (36), the method comprising providing a blank (34) having a cylindrical tube stub (36) which is integrally attached to the top plate (12), the internal diameter (e1) and external diameter (f1) of the tube stub (36) of the blank being shorter than the corresponding diameters (e, f) of the screw plug (10), and expanding the tube stub (36) of the blank by generating pressure on an internal wall surface (19*a*) of the blind hole (18) of the tube stub (36), wherein the expanding step comprises inserting a plunger (50) which has a cross-section exceeding the internal diameter (e1) of the tube stub (36) of the blank (34) into the blind hole (18*a*) of the tube stub (36) of the blank as a mandrel tool which radially expands the tube stub, and wherein the external thread (22) is integrally formed by a separate thread rolling process after the expanding step.

2. Method according to claim 1, wherein the external surface (38) of the tube stub (36) is pressed radially outwards beyond a contour (25) of the bevelled portion (24) which is attached to the top plate (12) and is inclined towards the axis in cross-section.

3. Method according to claim 1, wherein the external thread (22) is integrally formed in the external pipe surface (38) of the expanded tube stub (36).

4. Method according to claim 3, wherein the external thread (22) is integrally formed in the region of the tube stub (36) axially defined by a base contour (25) of the bevelled portion (24), and/or wherein the external thread (22) is integrally formed in the external surface (38) of the tube stub (36) by the thread rolling process.

5. Method according to claim 4, wherein the external surface (38) of the tube stub (36) is pressed against a die enclosing said tube stub.

6. Method according to claim 1, wherein the screw plug is formed in such a way that the external thread (22) start at a contour (25), towards the pipe, of the bevelled portion (24), and wherein the external threads projects radially past the contour.

7. Method according to claim 1, wherein the screw plug is formed in such a way that in longitudinal section the bevelled portion (24), extending towards the top plate of the screw plug (10) forms an angle (w) measuring 30°, with the longitudinal axis (A) of the screw plug.

8. Method according to claim 1, wherein the screw plug is produced with a diameter (g) of the contour (25) of the bevelled portion (24) of 19.5 mm.

9. Method according to claim 1, wherein the screw plug is formed in such a way that a bottom (20) of a blind hole (18) of the tube stub (36) has a cross-section inclined from the wall surface (19) thereof towards the longitudinal axis (A) of the screw plug, and wherein a depth (c) of the wall surface (19) is 8 mm.

10. Method according to claim 1, wherein the screw plug is produced with a diameter (e) of the blind hole (18) of 14 mm and an external diameter (f) of the external thread (22) of 21 mm.

11. Method according to claim 1, wherein the screw plug is formed in such a way that at least one bevelled edge (15 or 17) inclined away from the end face (16) towards the top plate is associated with the end face, one bevelled edge (15, 17) inclined away from the end face (16) towards the top plate being associated with said end face on either side and transitioning into the external thread (22).

12. Method according to claim 1, wherein the blind hole (18) of the tube stub (36) extends axially into the tube stub (36) to a depth (c) which comprises a substantial portion of an axial length (H) of the external thread (22).

* * * * *